US005711819A

United States Patent [19]

Miyasaki

[11] Patent Number: 5,711,819

[45] Date of Patent: Jan. 27, 1998

[54] METHOD FOR CLEANING THE INTERIOR OF TANKS AND OTHER OBJECTS

[76] Inventor: Mace T. Miyasaki, 6203 Blackburn La., Baltimore, Md. 21212

[21] Appl. No.: 639,087

[22] Filed: Apr. 24, 1996

[51] Int. Cl.[6] ..... B08B 9/08

[52] U.S. Cl. ..... 134/11; 134/19; 134/21; 134/22.18; 134/22.19; 134/31; 134/34; 34/470

[58] Field of Search ..... 134/11, 19, 21, 134/22.12, 22.14, 22.18, 22.19, 31, 34, 37; 34/77, 470

[56] References Cited

U.S. PATENT DOCUMENTS

| | | | |
|---|---|---|---|
| Re. 20,976 | 1/1939 | McFadden | 134/11 |
| 2,023,496 | 12/1935 | Todd | 87/5 |
| 2,065,462 | 12/1936 | Olsson | 134/22.18 |
| 3,046,163 | 7/1962 | Kearney et al. | 134/11 |
| 3,281,269 | 10/1966 | Watts | 134/22 |
| 3,401,060 | 9/1968 | Watts | 134/1 |
| 3,401,061 | 9/1968 | Watanabe | 134/22 |
| 3,549,421 | 12/1970 | McFadden et al. | 134/31 |
| 3,885,986 | 5/1975 | Dahm | 134/3 |
| 4,832,753 | 5/1989 | Cherry et al. | 134/22.18 |
| 4,992,247 | 2/1991 | Foti | 422/304 |
| 5,152,968 | 10/1992 | Foti et al. | 422/304 |
| 5,174,855 | 12/1992 | Tanaka | 156/626 |
| 5,178,841 | 1/1993 | Vokins et al. | 422/298 |
| 5,258,162 | 11/1993 | Andersson et al. | 422/28 |
| 5,286,301 | 2/1994 | Albrecht | 134/89 |

*Primary Examiner*—Peter A. Hruskoci
*Attorney, Agent, or Firm*—Foley & Lardner

[57] ABSTRACT

A method and apparatus for cleaning the interior of a container or one or more objects suspended therein comprising generating a fluid vapor column by forming an air column having a direction of air flow. The air column is passed through a heating means, so as to heat the air, and then the cleaning fluid is injected into the air column against the direction of air flow. The fluid vapor column is then brought into contact with the interior of the container so that the vapor condenses on the interior of the container or on objects suspended therein.

8 Claims, 1 Drawing Sheet

METHOD FOR CLEANING THE INTERIOR OF TANKS AND OTHER OBJECTS

BACKGROUND OF THE INVENTION

In the past, the predominant cleaning method for cleaning the interior of pipes, tanks, and other containers employed the use of high pressure water systems. Such systems required workers to physically enter tanks containing hazardous residues. Because of the danger to workers, OSHA has strengthened regulations relating to confined entry (Occupational Safety and Health Standards, Part 1910, Subsection 146). These regulations now require such costly safety equipment and procedures that the market is eagerly searching for ways to adopt new cleaning systems which minimize or eliminate the need for workers to enter tanks. In addition, the large volume of water and waste material generated by these high pressure water systems must be handled and disposed of properly.

Accordingly, methods and apparatus for using solvent vapor to clean the interior surfaces of a container, such as a tank or objects suspended therein have been proposed. For example, U.S. Pat. No. 2,023,496 discloses a method whereby a liquid solvent or diluent is heated and then applied to oil-covered surfaces of a tank or vessel. The solvent acts to liquify the oily deposits so as to release the deposit from the interior surface of the tank. Similarly, U.S. Pat. No. 3,046,163 teaches a method of cleaning the interior of a tank holding oil, grease, crude petroleum products, coal tar products, resinous products, paints or plasticizers comprising the steps of first passing hot vapor of a chlorinated hydrocarbon solvent into the tank and condensing the vapor on the tank walls, thereby dissolving adhering dissolvable matter on the interior surfaces of the tank.

The efficiency and efficacy of the cleaning apparatus is dependent largely on the efficiency of the vapor forming process in the first instance, and additionally vapor concentration within the container being cleaned. However, the prior art vaporizing processes have been found to be inefficient due to the relatively inefficient mechanisms for forming the vapor such that quantities of solvent remained liquified, and hence unusable. In addition, prior methods generally produce relatively low concentrations of vapor in the air stream which is being used to clean the interior of the container.

SUMMARY OF THE INVENTION

Accordingly, it is an object of the present invention to provide a more efficient method for cleaning the interior of a container or objects therein.

It is a further object to provide apparatus which can be used to clean the interior of containers or other objects according to the present method.

These and other objects are realized by providing a method for cleaning the interior of a container or objects therein comprising:

generating a fluid vapor column by forming an air column having a direction of air flow, heating said air column, and injecting a cleaning fluid into said air column at an angle to said direction of air flow;

bringing said fluid vapor column into contact with the interior of said container, and permitting a portion of said vapor to condense on said interior of said container and any of said objects contained therein, so as to form a condensed mixture of said cleaning fluid and any contaminants within said container or on said objects;

recycling or recovering any uncondensed portion of said vapor column, and removing said condensed mixture from the interior of said container.

The present invention also provides a system for cleaning the interior of a container or objects therein, said container having an inlet and one or more outlets, said system comprising:

a vapor generator for forming a vapor column of a cleaning fluid, said vapor generator comprising a fan for forming an air column having a direction of air flow, a heating means for heating said air column, and at least one atomizer which is capable of injecting said fluid into said air column at an angle to said direction of air flow;

wherein said vapor generator is in fluid communication with said container inlet whereby a vapor column formed by said vapor generator can enter said container.

Additional objects and advantages of the invention will be set forth in the description which follows, and in part will be obvious from the description, or may be learned by practice of the invention. The objects and advantages of the invention may be realized and obtained by means of the method and system particularly pointed out in the appended claims.

Figure 1:
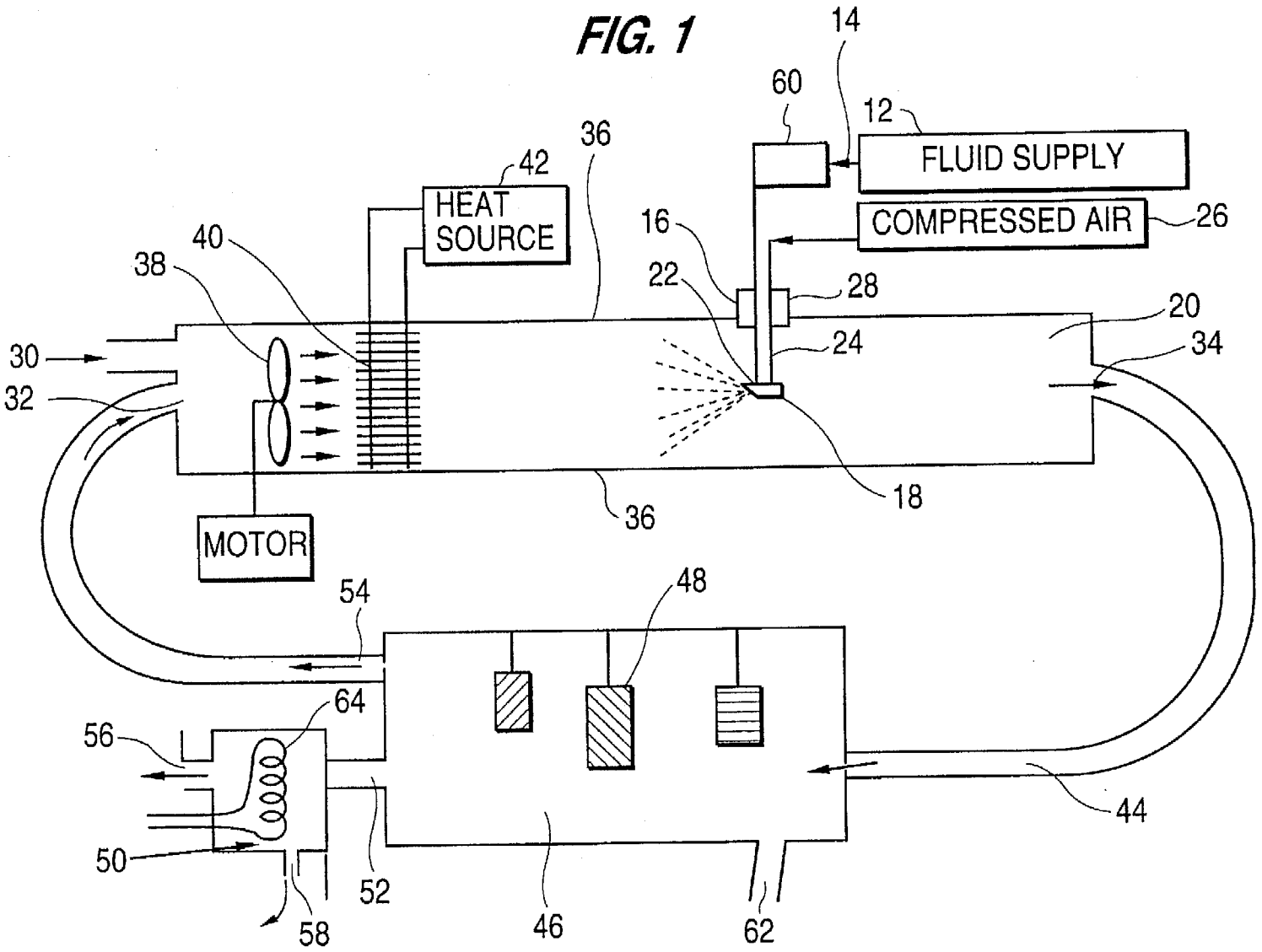
FIG. 1 is a schematic diagram showing the vaporizing cleaning method and apparatus of the present invention.

The accompanying drawing which is incorporated in and constitute a part of the specification, illustrates a presently preferred embodiment of the invention and, together with the general description herein, serves to illustrate the principles of the invention.

DETAILED DESCRIPTION

The present method may be used to clean any closed volume tank which contains residual coatings or deposits, and to clean applied coatings from the walls of the tank. Other treatments may include chemically reacting a cleaning fluid to alter the composition of a coating or to dissolve miscible materials. Tanks which can be cleaned include, for example, petroleum storage tanks, ballast tanks on ships, petroleum and chemical transport tanks, such as railroad tanker cars and tanker trucks, and chemical storage tanks of various kinds. In addition, coated elements such as those which are painted, chemically coated or treated and the like, as well as objects having deposits of unwanted substance thereon, can be cleaned by the present method.

It has been found that the method by which the cleaning fluid vapor is formed largely determines the resultant efficiency of the formation of the cleaning fluid vapor. In this regard, by generating a vapor in a heated air column, that is, rapidly flowing air which has been passed through a heat exchanger, a significantly higher concentration of cleaning fluid will be dissolved in the air than that which would be dissolved by injecting the cleaning fluid directly onto a heat source. Accordingly, very little, if any, residual unvaporized, cleaning fluid is wasted.

By injecting cleaning fluid droplets having relatively small particle sizes into the air stream, the percentage of cleaning fluid which is vaporized and the concentration of cleaning fluid in the resultant vapor can both be maximized. By injecting the cleaning fluid with an atomizing nozzle directly into air which has been heated, a very fine spray is produced. When this spray is injected at an angle to the direction of the air flow, preferably against the direction of flow, turbulence occurs and, therefore, more efficient mixing is accomplished.

This method comprises generating a cleaning fluid vapor column by forming a turbulent air column having a direction of air flow. The air column is passed through a heat exchanger, so as to heat the air, and then the cleaning fluid, which may be in admixture with compressed air, is injected into the air column against the direction of air flow resulting in turbulent mixing. The vapor column is then brought into contact with the interior of the container and a portion of the vapor is permitted to condense on the interior of the container and on any other objects contained therein so as to form a condensed mixture of the cleaning fluid and any contaminants (hereinafter, "dirty fluid") within the container. This dirty fluid is then removed from the container. The vapor which does not condense while in the container exits from an opposite side of the container and is preferably recirculated at any point in the system. Alternately, any or all of the uncondensed portion of the vapor column may be passed through a condensing chamber and either discarded or reused.

In order to accomplish the present method, the present invention creates an air column saturated with vapor from a cleaning fluid. The concentration of the vapor is dependent upon the temperature within the vaporization chamber, the velocity of air flow through the vaporization chamber and the volume of cleaning fluid which is injected into the air stream. In order to achieve optimum results, the characteristics of the cleaning fluid vapor should be carefully controlled. That is, the more highly concentrated the vapor, the greater the resultant absorption, and thus cleaning capacity, of the vapor. In addition, to achieve maximum efficiency, it is desirable that substantially all of the cleaning fluid is converted into vapor, thus eliminating the presence of liquid cleaning fluid in the vapor stream which is less effective in removing deposits and other residue from the tank interior or other objects therein.

Referring to FIG. 1, the apparatus, depicted generally as 10, comprises a vaporization chamber 20 including a fresh air inlet 30 on one end of the chamber and an outlet 34 on an opposite end thereof. The chamber may also optionally include a recycle inlet 32, preferably on the same end of the chamber as the fresh air inlet 30. The chamber 20 may be of any shape. At least one atomization nozzle 18 is provided within the vaporization chamber 20 and means are provided within the walls 36 of the chamber to accommodate the entry of hoses which are connected to a fluid supply 12 and a compressed air supply 26. The apparatus 10 preferably should be a completely closed system to control the concentration of the vapor, to contain any volatile odors or hazardous by-products and gases that may come from the cleaning fluid or the materials mixed or dissolved by the cleaning fluid. The components of the system should be constructed of materials that do not become corroded, dissolved, or otherwise attacked by the cleaning fluid or the materials mixed or dissolved by the cleaning fluid. Chemical compatibility tables should be reviewed to determine these factors.

The selection of an appropriate cleaning fluid should be based on the ability of the cleaning solution to be easily vaporized, its ability to dissolve the subject coating or material to be removed from the container, and its ability to condense at the ambient temperature of the within the container being treated. If possible, it is also preferred that the cleaning fluid be nontoxic, nonflammable, and relatively easy to handle. In addition, the cleaning fluid employed is preferably not destructive to other materials in which it will come into contact with. Suitable cleaning fluids include the family of compounds known as synthetic chlorinates, such as perchloroethylene, trichloroethane, trichloroethylene, and methylene chloride. For example, methylene chloride is commonly used for removing many kinds of paints. Perchloroethylene is commonly used for dry cleaning clothing, and can remove many kinds of stains, especially those based on petroleum.

From the supply tank 12, the cleaning fluid is fed to a pump 60. The pump is employed to provide a metered flow of cleaning fluid to a chamber 20 where vaporization of the cleaning fluid will be accomplished. Any pump which can handle metering and dosing cleaning fluids such as those mentioned supra is suitable. One such example of a suitable pump is the CHEMINJECTOR-D™ diaphragm metering pump manufactured by Hydroflo Corporation of Plumsteadville, Pa. The pump employed should be capable of handling both high and low pressures ranging from 10 psi–1100 psi. The pump should also be compatible with any corrosive cleaning fluids which are to be employed. In a preferred embodiment, the pump should be capable of delivering flows ranging from less than 0.5 gal/hr. to flows which exceed 8.0 gal/hr. It is contemplated that any pump capable of transferring a cleaning fluid from the supply tank to the vaporization chamber 20 under a range of different pressures will be suitable.

The cleaning fluid is fed from the supply tank 12 to the pump 60 via one or more hoses 14. The hoses 14 are preferably formed of either metal such as stainless steel, or a resin or coated resin such as TEFLON®. The pressure of the pumped cleaning fluid is preferably measured by a pressure gauge 16 prior to entering the atomization nozzle. The pressure gauge 16 may be electronically configured to cause the pump 60 to change the rate of cleaning fluid flow depending on the pressure being registered by the gauge 16. For instance, if the pressure being registered by the gauge 16 exceeds a predetermined amount, the gauge may send a signal to the pump 60 to correspondingly decrease the flow of cleaning fluid being administered. Similarly, if the pressure drops below a set level, a signal may be sent to the pump 60 to increase the flow rate. Alternately, either the gauge 16 or the pump 60 may be set to deliver a particular pressure of cleaning fluid for a set time period and then the pressure may be automatically increased or decreased as required. Accordingly, it is contemplated that the gauge 16 and pump 60 may operate automatically, manually or both to control the flow of cleaning fluid. It is contemplated that any conventional pressure gauge would be suitable for use in the present apparatus. For example, a 200 PSI Bourden tube pressure gauge such as manufactured by U.S. Gauge may be employed.

After exiting the pump, the cleaning fluid flows through the aforementioned hose into at least one atomization nozzle 18 mounted in the vaporization chamber at its liquid fluid inlet 22. After exiting the pressure gauge 16, the cleaning fluid flows into the vaporization chamber and directly into at least one atomization nozzle 18 at its liquid fluid inlet 22. The atomization nozzle 18 being employed is most preferably an air atomizing spray nozzle. Air atomizing nozzles are known in the art. For example, a suitable air atomizing nozzle is the AL/ALX 45 Series™ nozzle manufactured by Delavan of Lexington, Ky. Unlike hydraulic or pressurized nozzles where the energy from the pressure of the liquid is used to atomize, an air atomizing nozzle such as that contemplated uses the energy of a pressurized gas, typically air, to atomize the fluid. The use of an air atomizing nozzle permits the cleaning fluid to be fed under substantially lower pressures and still achieve fine atomization. Since many cleaning fluids are corrosive, a relatively low pressure flow may be desirable. Although other types of nozzles could also be employed, it is preferable to employ an air atomizing nozzle to achieve the highest cleaning fluid concentration in the resultant vapor.

In the event the nozzle 18 is an air atomizing nozzle, it includes the fluid inlet 22 and an air inlet 24. The air inlet 24 is in fluid communication with a supply of compressed gas 26, which is preferably air. Between the supply of compressed gas or air 26 and the air inlet 24, there is included an air pressure gauge/regulator 28. The regulator 28 is used to select and control the desired amount of air pressure from the air supply 26. By monitoring the air pressure and the liquid pressure with the air pressure gauge 28 and the fluid pressure gauge 16, it is possible to accurately determine the flow exiting the nozzle 18. An air atomizing nozzle may be either an external air atomizing nozzle or an internal air atomizing nozzle. An external air atomizing nozzle is designed so that the airflow intersects the liquid flow at the face of the nozzle. An internal air atomizing nozzle, on the other hand, atomizes the fluid internally by mixing the air and the fluid inside the nozzle.

The external air atomizing nozzle permits control of the atomization without altering the liquid flow rate. In essence, the higher the air pressure, the finer the atomization for a given liquid pressure. With respect to an internal air atomizing nozzle, the atomization is controlled by changing the air pressure as well as the liquid flow rate or pressure. Therefore, the use of an internal air atomizing nozzle may be preferable to achieve maximum atomization control and therefore, minimum droplet size. However, it is possible to achieve a particular desired degree of atomization with either the internal or external type.

The low liquid flow rates and air atomization of an air atomization nozzle permit extremely fine atomization; for example, droplet sizes below 50 microns can be expected. Moreover, when employed with lower liquid flow rates, droplet sizes below 20 microns are not uncommon.

For a given liquid pressure, an increase in air pressure will result in a decrease in liquid flow through the nozzle and a corresponding decrease in droplet size. A decrease in air pressure will increase the liquid flowing through the nozzle, thus increasing droplet size.

Depending upon the type of vessel which is to be cleaned and the type of cleaning fluid or fluids employed, a hydraulic atomizing nozzle may also be used either in addition to an air atomizing nozzle or in combination therewith. An air atomizing nozzle typically requires liquid pressures ranging from 10 to 100 psi whereas a hydraulic atomizing nozzle requires liquid pressures ranging from 100 to 1100 psi. In many applications, an air atomizer will be desirable because of the lower working pressures required and the resultant greater safety factor obtained in use with the present arrangement.

Hydraulic atomizing nozzles employ hydraulic pressure which creates a liquid shear through the orifice of the nozzle, to accomplish atomization of the cleaning fluid. The orifice size of the hydraulic nozzle should be chosen based upon the atomization desired and the flow rate of the cleaning fluid. The hydraulic nozzle, if employed, may have its own connection to a cleaning fluid, or alternately, the hydraulic nozzle may be adapted to be used with the same hoses 14 and pressure gauge 16 as the air atomizing nozzle. It is therefore contemplated that an air atomizing nozzle could atomize a first cleaning fluid while a hydraulic nozzle atomizes a second fluid.

It may also be desirable to include one or more humidification units (not shown) within the vaporization chamber 20, but such units will be most efficient at low air flow velocities. Humidification units produce a very fine fog-like mist and, particularly at low air flow velocities, could produce sufficient vapor concentration.

In the event the chamber is provided with a humidification unit or multiple atomization nozzles, it is contemplated that the walls 36 of the chamber will accommodate the entry of any necessary components, i.e., a hydraulic fluid source, power source, and the like.

Within the vaporization chamber 20, there is also provided a fan 38, which is preferably a compressed-air powered fan which is known in the art. For example, a suitable compressed air fan which does not have an in-line motor which would act as an impediment to the flow of the air, is the Model RF-12 Compressed Air Driven Blower manufactured by Coppus Portable Ventilation Division of Tuthill Corporation. However, there are a number of other fan units which could function in a similar capacity. A squirrel cage-type blower or any other air moving device could also be used as long as a sealed system is maintained.

The fan 38 is located adjacent to the air inlet 30 and may even completely cover the cross-sectional area of the inlet 30. The fan 38 should be capable of variable speeds. In the event a compressed air fan is employed, the speed, and therefore the output of the fan, is a function of the inlet air pressure and volume. By regulating the inlet air pressure or volume, the output of the fan can be varied.

The size of the fan can vary depending on the size of the air inlet 30 and the pressure within the vaporization chamber 20 against which the fan 38 is moving air. The expansion of the air flow as air enters the vaporization chamber 20 causes a reduction in speed and air pressure. By placing the fan 38 at the air inlet 38 of the vaporization chamber 20, the density of the air in the vaporization chamber 20 is maximized. By maximizing the density of air in the vaporization chamber 20, the volume of vapor which can be absorbed is maximized, which ultimately maximizes the cleaning efficiency of the cleaning fluid vapor.

The atomizing nozzle 18 is preferably located downstream from the inlet 30 and fan 38. The nozzle 18 is oriented such that the atomized cleaning fluid is injected directly into the flow of air being blown by the fan 38. This arrangement maximizes the distribution in the air column of the atomized cleaning fluid.

The injection of the cleaning fluid into the air column may be conducted at any angular orientation. In a particularly preferred embodiment, the nozzle 18 is oriented such that the atomized cleaning fluid is injected directly into the air column at a 180° angle. Alternately, the cleaning fluid may be injected at any other angle. For example, depending on the configuration of the chamber 20, the position of the nozzle 18 may be variable so that the cleaning fluid is injected at any desired angle, or the nozzle 18 could be held fixed at any particular angle.

Vaporization is primarily a function of the mass of cleaning fluid to be vaporized, the mass of the air column, and the differential temperature therebetween. Therefore, in order to obtain a high degree of vaporization, it is expedient to provide heat to the system. Many cleaning fluids will decompose when heated directly, often producing corrosive acids in the process. Thus, it is beneficial to provide heat to the air column prior to contact with the cleaning fluid.

In a preferred embodiment, there is provided heating means 40 directly downstream from the fan and oriented between the fan 38 and the nozzle 18. The air column generated by the fan 38 flows directly through the heating means 40 so that the air column is heated at the point of contact with the atomized cleaning fluid.

Any heating means which is capable of heating an air column is suitable. The heating means 40 is preferably of a type which does not emit a flame or include any component which might cause ignition or explosion of the cleaning fluid being employed. The heating means 40 should be positioned directly downstream from the fan 38. The heating means 40 preferably should cover substantially the entire cross section of the vaporization chamber 20 so as to heat as much of the air flow generated by the fan 38 as possible. As the cleaning fluid is injected by the nozzle 18 into the heated air flow, the atomized cleaning fluid will vaporize and a highly saturated air column of vapor is formed.

The heating means 40 should present a minimal impediment to the flow of air and not corrode or otherwise deteriorate in the air column. The heating means 40 is preferably mounted in brackets so that it is substantially perpendicular to the air flow in the vaporization chamber 20.

In a particularly preferred embodiment, the heating means 40 is comprised of a heat exchange unit. Many commercially available heat exchange units are suitable for use in the present invention, for example, the Hayden Heavy Duty Rapid-Cool Transmission Cooler and Heavy Duty Oil Cooler, and the Tekonsha Defender Model 4336A Motorhome Transmission Cooler. The type and manufacture of the heat exchange unit can vary depending on the configuration of each particular individual system. A tube-and-fin type heat exchanger known to those skilled in the art is contemplated as being particularly suitable.

In the event a heat exchange unit is used as the heating source, it will most likely be necessary to include a heat source 42 to supply heated fluid or gas to the heating means 40. A heat source 42 may also be used in connection with other possible heating units. The heat source 42, if employed, should be capable of supplying sufficient heated fluid or gas to maintain a relatively uniform temperature across the contact surface of the heating means 40.

Many conventional heat sources 42 are suitable for providing heat to the heating means 40, including the CL series circulating heating systems manufactured by the Kim Hotstart Company. The heat source 42 may be powered by electricity, oil, gas, steam, solar energy, or by any conveniently available source of power.

As the cleaning fluid is injected by the nozzle 18 into the now heated air flow, a highly saturated air column of saturated heated vapor is formed. The vapor column flows out of the vaporization chamber through the outlet 34 located downstream from the nozzle 18. The position of the inlet 30, recycle inlet 32, outlet 34, nozzle 18, fan 38 and heating means 40 within the vaporization chamber 20 may vary depending on many factors such as the composition of the cleaning fluid, the temperature, pressure, and the type of nozzle being employed. The depiction of FIG. 1 is intended to be illustrative and not limiting, since many other arrangements of the apparatus can be employed without departing from the disclosure.

The heated vapor column is now ready to be employed to clean a closed volume tank 46 which contains residual deposits. Alternately, the vapor may be used to clean objects having residual coatings 48 which are placed directly into the tank 46. The heated vapor column flows out of the outlet 34 of the chamber 20 to the container or tank 46 being treated. The chamber 20 may be connected to the tank 46 directly. Alternately, the vapor may flow through a hose or conduit 44 which is connected to the tank 46 to be cleaned. It is anticipated that the entire apparatus may be easily assembled and disassembled so that the chamber 20, hoses 44, supply tanks 12, 26, and the other components may be readily transported to a location and set up to form a closed system where a tank 46 to be cleaned is located. In order to ensure complete sealing of a portable system, seals may be provided between the components of the apparatus. It is also envisioned that a stationary system could be set up whereby the tank 46 is part of the apparatus 10 and objects 48 which are to be treated are transported to the apparatus 10 and placed into the tank 46. The apparatus may be either stationary or portable depending upon the requirements of the user. For example, exemplary containers that could be cleaned by conducting the vapor through a hose or conduit include railroad tank cars, ship ballast tanks, ship fuel tanks, over-the-road tanker trailers, barges, industrial storage tanks, and petroleum storage tanks. Examples of objects that could be placed in a stationary tank for treatment include, for example, items from which paint, chemicals, or coatings need to be removed, especially items with irregular surfaces or fragile structures.

The vapor column flows through the conduit substantially all the cleaning fluid being employed and then transport 44 and into the tank 46. The goal is to first vaporize as much of the vapor which has been formed into the tank or container 46 which is to be cleaned without incurring any significant condensation. Thus, it may be desirable to include supplemental heaters within or about the periphery of the conduit 44. Alternately, the conduit 44 may be relatively short in length and/or well insulated and/or formed of a material that conducts heat poorly, to eliminate significant cooling while the vapor is within its confines. As the saturated vapor column enters the tank 46, the vapor is permitted to condense on the inner surface of the tank 46 or on any objects 48 within the tank 46. If it is desired that the vapor condense on the walls of the tank, the tank should be maintained at a temperature which is lower than the condensation temperature of the vapor. If it is desired that the vapor condense on objects within the tank, the objects should be at a temperature which is lower than the condensation temperature of the vapor, and the tank should preferably be maintained at a temperature higher than the condensation temperature, thereby decreasing the amount of vapor condensing on the walls of the tank and consequently increasing the efficiency of the operation.

As the heated vapor column condenses on the inner surface of the tank 46 or any object(s) placed in the container 48, the now liquid phase cleaning fluid will dissolve deposits on the contacted surfaces. Unvaporized cleaning fluid is relatively less effective in dissolving the deposits on the surfaces to be cleaned. Thus, it is highly desirable that a high percentage of the cleaning fluid is vaporized. In a preferred embodiment, approximately 90%, more preferably 95%, and most preferably 100% of the fluid is vaporized. It is also contemplated that the composition of the cleaning fluid may be tailored to correspond with the types of coatings or deposits which are sought to be removed from a tank or particular objects. For instance, perchloroethylene can be used to remove petroleum based products and methylene chloride can be used to remove many paints.

The apparatus may include multiple cleaning fluid supply tanks 12 which may be easily varied depending on the object to be cleaned. For instance, a first cleaning fluid may be atomized into the heated air column and passed into the tank. After a specific period of time has elapsed, a manual or automatic control may permit the cleaning fluid being introduced into the atomization nozzle 18 to be provided from a second supply tank containing a different or possibly a different strength or concentration of cleaning fluid. The system may also be configured so that a rinsing mechanism is activated prior to the use of a different cleaning fluid to reduce the likelihood of contamination or chemical reaction between different cleaning fluids.

After condensing on the surfaces of the tank 46 and objects 48, the now "dirty" condensed fluid is permitted to exit the tank 46 and either disposed of, subjected to further treatment, and/or recycled to the vaporization chamber 20 to be reused. The tank 46 may be provided with a drain 62 in the lower portion thereof to permit the dirty condensed fluid, which will flow downward due to gravity, to exit the tank. It is contemplated that the drain could permit either continuous draining of the dirty liquid or the drain could include a mechanical or electrical valve which would permit selective draining. Alternatively, after completion of the cleaning procedure, the tank 46 could be purged of the dirty fluid by any other means. For example, a pump (not shown) could be inserted into the tank to pump the condensed dirty liquid out of the tank, or the tank could be rotated to permit the dirty liquid to drain from any other opening in the tank.

Any uncondensed vapor may be recirculated within the system. For example, the recirculated vapor could be reintroduced directly into the closed volume tank 46, or could be cycled into the vaporization chamber 20 at any point. Alternately, the recycled vapor stream could be introduced into the conduit 44 between the chamber 20 and the tank 46. The vapor to be recycled could be routed out of the tank 46 through a vapor outlet conduit attached to the tank 46 at a point opposite the point of vapor entry at conduit 44. If the recycled vapor is recycled to the vaporization chamber 20, the recycle vapor would reenter the chamber 20 through a recycle inlet 32 or at any other tank inlet. By recycling the unused vapor, a closed system is maintained.

In another embodiment, if it were impractical or for some other reason undesirable to recycle the unused vapor, an alternate arrangement whereby the vapor is filtered or condensed through a secondary mechanism is a possibility. In this case, at least a portion of the uncondensed vapor is passed through a conduit 52 into a cooling chamber 50 having a temperature lower than the boiling point of the cleaning fluid being used so as to quickly liquify all residuals. A suitable cooling chamber 50 would include a condenser 64, a drain 58 for the condensed fluid and an outlet for clean air 56. It will be appreciated that conduit 52 and chamber 50 could be connected to conduit 54 if the tank 46 has only one exit or if it were for any other reason practical that all uncondensed vapor be removed from the tank 46 at the same location.

The following examples are illustrative of a preferred embodiment of the present invention and in no way should be construed as limiting the invention.

EXAMPLES

Example 1

In example 1, a tank (4 feet×4 feet×5 feet) is coated with a petroleum based coating that is to be removed completely to the bare metal. The coating is removed by introducing a vapor of perchloroethylene into the tank. The perchloroethylene is fed to a single AL/ALX 45-04 internal mixing nozzle manufactured by Delavan. The fluid is fed into the nozzle at a pressure of 30 PSI at a rate of 5 gallons per hour. Compressed air is fed into the nozzle at a pressure of 45 PSI. The nozzle is located in a 1 foot square stainless steel vaporization chamber which has a single air inlet and a vapor outlet disposed on opposite ends of the chamber.

Adjacent to the air inlet is provided a Coppus Model RF12 Blower powered by compressed air, and the blower is operated to push air out of the vapor chamber at the velocity of 100 feet per minute. The volume of vapor is therefore 100 cubic feet per minute. Between the blower and the nozzle is provided a fin and tube heat exchanger manufactured by Hayden through which heated water is pumped. The water is heated by a small electrically powered heating unit and pumped by a small circulating pump. The temperature of the water returning from the heat exchanger is measured and the flow rate of the water is adjusted so that the temperature of the returning water was approximately 140 degrees F. The heat exchanger is mounted across the chamber at a right angle to the flow of air so that the air from the blower passes through the heat exchanger.

The nozzle is pointed directly toward the heat exchanger so that the atomized fluid is directed into the flow of heated air. The resulting vapor is transported directly into the tank at the rate of 100 cubic feet per minute. The tank is at an ambient temperature of 65 degrees F., and the vapor readily condenses on the walls of the tank. Any uncondensed vapor is redirected to the air inlet of the vaporization chamber. The flow of air from the tank recirculates through the inlet of the vaporization chamber. Any excess air pressure is released through a filter into the atmosphere.

After a period of 30 minutes, a total of approximately 2.7 gallons of condensed liquid has collected on the bottom of the tank. The condensed liquid with the coating in solution is drained out of the tank through a bottom drain. Using this process, approximately 0.2 gallons of coating is solubized from the interior walls of the tank.

Example 2

Painted metal objects are treated to expose the bare metal. The objects are hung in the tank described in example 1 and the vapor introduced in a like manner. Using perchloroethylene or methylene chloride as the cleaning fluid to create the vapor, the vapor condenses on the objects and causes the paint to flake off the objects and fall to the bottom of the tank. The time required to strip off all the paint depends on the type and thickness of paint on the objects and the type of cleaning fluid used. A typical object painted with common lacquer will be stripped of its paint in about ten to fifteen minutes. The paint chips will collect on the bottom of the tank and can be collected in a dry state after the vapor has been purged from the tank. If the paint is an especially hard, it may be helpful to cool the object before placing it in the tank, thereby increasing the temperature difference between the object and the vapor which accelerates the rate of vapor condensation on the object.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A method for cleaning the interior of a container or objects therein comprising:

generating a fluid vapor column in a vaporization chamber by forming a air column having a direction of air flow, heating said air column, and injecting a cleaning fluid into said air column at an angle to said direction of air flow; flowing said fluid vapor column through an outlet of said vaporization chamber;

bringing said fluid vapor column from said outlet into contact with the interior of said container, and permitting a portion of said vapor to condense on said interior of said container and on any of said objects contained therein, so as to form a condensed mixture of said cleaning fluid and any contaminants within said container or on said objects;

recycling or recovering any uncondensed portion of said vapor column; and removing said condensed mixture from the interior of said container.

2. A method according to claim 1, wherein at least a portion of said uncondensed portion of said vapor column is recirculated through said container.

3. A method according to claim 1, wherein the air column is heated by a heat exchange unit.

4. A method according to claim 1, wherein at least a portion of said uncondensed portion of said vapor column is recovered by passing said uncondensed portion through a condensing chamber.

5. A method according to claim 1, wherein said fluid is a cleaning fluid.

6. A method according to claim 5, wherein said cleaning fluid is selected from the group consisting of perchloroethylene, 1,1,1 trichloroethane, trichloroethylene, and methylene chloride.

7. A method according to claim 1, wherein said vapor column comprises vapor droplets of 20 microns or less.

8. A method according to claim 1, wherein a mixture of compressed air and said cleaning fluid are injected into said air column.

* * * * *